US007980552B2

(12) United States Patent
Sawai

(10) Patent No.: US 7,980,552 B2
(45) Date of Patent: Jul. 19, 2011

(54) PAPER FEED CASSETTE

(75) Inventor: Kunio Sawai, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 535 days.

(21) Appl. No.: 11/752,697

(22) Filed: May 23, 2007

(65) Prior Publication Data

US 2007/0273082 A1 Nov. 29, 2007

(30) Foreign Application Priority Data

May 24, 2006 (JP) ..... 2006-144120

(51) Int. Cl.
*B65H 1/08* (2006.01)

(52) U.S. Cl. ..... 271/126; 271/147

(58) Field of Classification Search ..... 271/126, 271/127, 147, 160, 241
See application file for complete search history.

(56) References Cited

U.S. PATENT DOCUMENTS

| | | | | |
|---|---|---|---|---|
| 1,419,733 | A * | 6/1922 | Hitchcock | 271/126 |
| 3,720,407 | A * | 3/1973 | Woodward | 271/161 |
| 5,401,014 | A * | 3/1995 | Okabe et al. | 271/255 |
| 5,752,696 | A * | 5/1998 | Nakatani et al. | 271/127 |

FOREIGN PATENT DOCUMENTS

| | | | |
|---|---|---|---|
| JP | 5-24664 | A | 2/1993 |
| JP | 8-244996 | A | 9/1996 |
| JP | 2001-213528 | A | 8/2001 |

* cited by examiner

*Primary Examiner* — Michael C McCullough
(74) *Attorney, Agent, or Firm* — Crowell & Moring LLP

(57) ABSTRACT

A paper feed cassette capable of inhibiting a paper from being warped in a direction substantially perpendicular to a paper feed direction while minimizing increase in the number of component and inhibiting the paper from being plastically deformed into a curved shape is obtained. The paper feed cassette includes a cassette body storing the paper, a first lift member for lifting up the paper so as to bring the paper into contact with a paper feed roller in printing, and a second lift member for lifting up the paper so as to produce bending caused by droop of the rear in the paper feed direction of the paper due to the paper's own weight in printing.

19 Claims, 8 Drawing Sheets

PAPER FEED CASSETTE

BACKGROUND OF THE INVENTION

1. Field of the Invention

The present invention relates to a paper feed cassette, and more particularly, it relates to a paper feed cassette mounted on an image generating apparatus.

2. Description of the Background Art

A paper feed cassette mounted on an image generating apparatus is known in general.

Japanese Patent Laying-Open No. 5-24664 (1993) discloses a paper feed cassette in which an envelope (paper) is placed on a convexly curved bottom plate (first push up member) and the envelop placed on the bottom plate is pressed by two pressure rollers mounted on forward ends of two plate springs mounted on a cassette top cover (lid member), for example. In the paper feed cassette, the envelope is lifted up by the convexly curved bottom plate and the lifted envelope comes into contact with a pick-up roller (paper feed roller). In the paper feed cassette, the two pressure rollers mounted on the two plate springs press a rear portion in a paper feed direction of the envelope against the convexly curved bottom plate, whereby the envelope is convexly curved along a convexly curved portion of the bottom plate. Thus, the envelope linearly extends along a direction (direction substantially perpendicular to the paper feed direction) in which the convexly curved portion extends, whereby warpage in the direction substantially perpendicular to the paper feed direction is inhibited from occurring in the envelope.

Japanese Patent Laying-Open No. 2001-213528 discloses a paper feed cassette in which a sheet material (paper) is lifted up by a lifter plate (first lift member) and the lifted sheet material comes into contact with a pick-up roller (paper feed roller).

Japanese Patent Laying-Open No. 8-244996 (1996) discloses a structure of a paper feed board in which a sheet (paper) is lifted up by a pressure plate and the lifted sheet comes into contact with a paper feed roller.

In the paper feed cassette disclosed in Japanese Patent Laying-Open No. 5-24664, however, the two plate springs mounted on the cassette top cover and the two pressure rollers mounted on the two plate springs must be provided in order to convexly curve the envelope (paper), whereby the number of components is disadvantageously increased. Additionally, the envelope (paper) is placed on the convexly curved bottom plate also in nonprinding, whereby the envelope (paper) is disadvantageously plastically deformed into a curved shape.

In the structures of the paper feed cassette disclosed in Japanese Patent Laying-Open No. 2001-213528 and the paper feed board disclosed in Japanese Patent Laying-Open No. 8-244996, no structure inhibiting the warpage in the direction substantially perpendicular to the paper feed direction from occurring in the sheet material and the sheet is conceivably disclosed nor suggested dissimilarly to the paper feed cassette disclosed in Japanese Patent Laying-Open No. 2001-213528.

SUMMARY OF THE INVENTION

The present invention has been proposed in order to solve the aforementioned problems, and an object of the present invention is to provide a paper feed cassette capable of inhibiting a paper from being warped in a direction substantially perpendicular to a paper feed direction while minimizing increase in the number of component and inhibiting the paper from being plastically deformed in a curved shape.

In order to attain the aforementioned object, a paper feed cassette according to a first aspect of the present invention comprises a cassette body mounted on an image generating apparatus including a paper feed roller and storing a paper, a first lift member for lifting up the paper so as to bring the paper into contact with the paper feed roller of the image generating apparatus in printing, and a second lift member for lifting up the paper so as to produce bending caused by droop of the rear in a paper feed direction of the paper due to the paper's own weight in printing.

In the paper feed cassette according to the first aspect, as hereinabove described, the second lift member for lifting up the paper so as to produce the bending caused by the droop of the rear in the paper feed direction of the paper due to the paper's own weight is provided, whereby the paper linearly extends in a direction in which the bending due to the droop extends (in a direction substantially perpendicular to the paper feed direction) and therefore the paper can be inhibited from being warped in the direction substantially perpendicular to the paper feed direction. Thus, the paper can be inhibited from disadvantageously deviating in the direction substantially perpendicular to the paper feed direction due to the warpage of the paper, thereby allowing improvement in printing quality. Additionally, simply adding the one second lift member can inhibit the paper from being warped in the direction substantially perpendicular to the paper feed direction, whereby increase in the number of components can be minimized. The first lift member and the second lift member are so formed as to lift up the paper in printing, whereby the paper is curved due to the droop only in printing while the paper is not curved in nonprinting. Thus, the paper can be inhibited from being plastically deformed into a curved shape.

In the aforementioned paper feed cassette according to the first aspect, the second lift member preferably includes a paper support portion so formed as to come into contact with the paper when the paper is lifted up and extend in a direction substantially perpendicular to the paper feed direction. According to this structure, the droop due to the paper's own weight can be easily produced along the paper support portion of the second lift member.

In the aforementioned paper feed cassette in which the second lift member includes the paper support portion, the paper support portion of the second lift member preferably has a length substantially not less than the width of the paper in the direction substantially perpendicular to the paper feed direction. According to this structure, the paper support portion can produce the bending due to the droop over an overall length in a width direction of the paper, whereby the paper can be linearly extended over the overall length in the width direction of the paper.

In the aforementioned paper feed cassette in which the second lift member includes the paper support portion, the cassette body preferably includes an urging portion urging a side surface of the paper in the direction substantially perpendicular to the paper feed direction in the vicinity of a portion at which the paper support portion of the second lift member and the paper come into contact with each other. According to this structure, the side surface of the paper can be urged in the direction substantially perpendicular to the paper feed direction by the urging portion in the vicinity of the portion at which the paper is inhibited from being warped in the direction substantially perpendicular to the paper feed direction so that positioning of the paper in the direction substantially perpendicular to the paper feed direction can be accurately performed. Thus, the paper can be inhibited from deviating in the direction substantially perpendicular to the paper feed direction.

In this case, the paper feed cassette preferably further comprises a lid member covering the paper stored in the cassette body, wherein the urging portion of the cassette body is so formed as to urge the side surface of the paper in the direction substantially perpendicular to the paper feed direction when the lid member is in an open state for mounting the cassette body on the image generating apparatus. According to this structure, the paper can be inhibited from deviating in the direction substantially perpendicular to the paper feed direction in printing. The paper can be prevented from application of a load in nonprinting by releasing the urging to the side surface of the paper when the lid member is brought into a closed state.

In the aforementioned paper feed cassette according to the first aspect, the first lift member preferably includes an engaging portion engaging with a lower surface of the second lift member, and the second lift member is preferably lifted up by the engaging portion of the first lift member when the first lift member is lifted up. According to this structure, the second lift member can be easily lifted up by lifting up the first lift member.

In the aforementioned paper feed cassette in which the first lift member includes the engaging portion, the engaging portion of the first lift member preferably includes a pair of engaging portions protruding outward from both side surfaces of the first lift member. According to this structure, the pair of engaging portions can support the vicinity of both sides of the second lift member, whereby the second lift member can be lifted up in a stable state.

In the aforementioned paper feed cassette in which the first lift member includes the engaging portion, a recess portion in which the engaging portion of the first lift member is arranged when the first lift member is not lifted up is preferably formed on a bottom surface of the cassette body. According to this structure, the engaging portion is arranged in the recess portion when the first and second lift members are not lifted up, whereby a paper placement surface of the first lift member and a paper placement surface of the second lift member can be substantially aligned with each other.

In the aforementioned paper feed cassette according to the first aspect, a position in a height direction when lifting up the second lift member is preferably substantially same as a position in a height direction when lifting up the first lift member. According to this structure, the paper is fed in a horizontal state with respect to a paper separating wall of the image generating apparatus, whereby the paper separating wall can easily perform paper separation. Thus, double feeding of the paper can be suppressed.

In the aforementioned paper feed cassette according to the first aspect, a support portion for supporting the paper is preferably formed on a bottom surface of the cassette body, and the height of the support portion of the cassette body is preferably substantially same as the height of a paper placement surface of the first lift member when not lifting up the first lift member and the height of a paper placement surface of the second lift member when not lifting up the second lift member. According to this structure, the paper can be stored in the cassette body in a flat state in nonprinting.

In the aforementioned paper feed cassette according to the first aspect, the paper feed cassette preferably further comprises a lid member covering the paper stored in the cassette body, wherein the lid member is preferably integrally provided with a contact portion coming into contact with the paper when the paper is lifted up. According to this structure, the contact portion of the lid member can be easily produce the bending due to the droop while inhibiting the number of component from increase.

In the aforementioned paper feed cassette according to the first aspect, the first lift member may be rotatably mounted on a bottom surface of the cassette body in a first direction, and the second lift member may be rotatably mounted on the bottom surface of the cassette body in a second direction different from the first direction.

A paper feed cassette according to a second aspect of the present invention comprises a cassette body mounted on an image generating apparatus including a paper feed roller and storing a paper, a first lift member for lifting up the paper so as to bring the paper into contact with the paper feed roller of the image generating apparatus in printing, and a second lift member for lifting up the paper so as to produce bending caused by droop of the rear in a paper feed direction of the paper due to the paper's own weight in printing, wherein the first lift member includes an engaging portion engaging with a lower surface of the second lift member, the second lift member includes a paper support portion so formed as to come into contact with the paper when the paper is lifted up and extend in a direction substantially perpendicular to the paper feed direction, and is lifted up by the engaging portion of the first lift member when the first lift member is lifted up, a position in a height direction when lifting up the second lift member is substantially same as a position in a height direction when lifting up the first lift member, and the cassette body includes an urging portion urging a side surface of the paper in the direction substantially perpendicular to the paper feed direction in the vicinity of a portion at which the paper support portion of the second lift member and the paper come into contact with each other.

In the paper feed cassette according to the second aspect, as hereinabove described, the second lift member for lifting up the paper so as to produce the bending caused by the droop of the rear in the paper feed direction of the paper due to the paper's own weight is provided, whereby the paper linearly extends in a direction in which the bending due to the droop extends (in a direction substantially perpendicular to the paper feed direction) and therefore the paper can be inhibited from being warped in the direction substantially perpendicular to the paper feed direction. Thus, the paper can be inhibited from disadvantageously deviating in the direction substantially perpendicular to the paper feed direction due to the warpage of the paper, thereby allowing improvement in printing quality. Additionally, simply adding the one second lift member can inhibit the paper from being warped in the direction substantially perpendicular to the paper feed direction, whereby increase in the number of components can be minimized. The first lift member and the second lift member are so formed as to lift up the paper in printing, whereby the paper is curved due to the droop only in printing while the paper is not curved in nonprinting. Thus, the paper can be inhibited from being plastically deformed into a curved shape. Further, the second lift member includes the paper support portion so formed as to come into contact with the paper when the paper is lifted up and extend in the direction substantially perpendicular to the paper feed direction, whereby the droop due to the paper's own weight can be easily produced along the paper support portion of the second lift member.

In the second aspect, the cassette body includes the urging portion urging the side surface of the paper in the direction substantially perpendicular to the paper feed direction in the vicinity of the portion at which the paper support portion of the second lift member and the paper come into contact with each other, whereby the side surface of the paper can be urged in the direction substantially perpendicular to the paper feed direction by the urging portion in the vicinity of the portion at which the paper is inhibited from being warped in the direction substantially perpendicular to the paper feed direction so that positioning of the paper in the direction substantially perpendicular to the paper feed direction can be accurately performed. Thus, the paper can be inhibited from deviating in the direction substantially perpendicular to the paper feed direction. The first lift member includes the engaging portion engaging with the lower surface of the second lift member, and the second lift member is lifted up by the engaging portion of the first lift member when the first lift member is lifted up, whereby the second lift member can be easily lifted up by lifting up the first lift member. The position in the height direction of the second lift member is substantially same as the position in the height direction of the first lift member, whereby the paper is fed in a horizontal state with respect to a paper separating wall of the image generating apparatus. Therefore, the paper separating wall can easily perform paper separation. Thus, double feeding of the paper can be suppressed.

In the aforementioned paper feed cassette according to the second aspect, the paper support portion of the second lift member preferably has a length substantially not less than the width of the paper in the direction substantially perpendicular to the paper feed direction. According to this structure, the paper support portion can produce the bending due to the droop over an overall length in a width direction of the paper, whereby the paper can be linearly extended over the overall length in the width direction of the paper.

In the aforementioned paper feed cassette according to the second aspect, the paper feed cassette preferably further comprises a lid member covering the paper stored in the cassette body, wherein the urging portion of the cassette body is preferably so formed as to urge the side surface of the paper in the direction substantially perpendicular to the paper feed direction when the lid member is in an open state for mounting the cassette body on the image generating apparatus. According to this structure, the paper can be inhibited from deviating in the direction substantially perpendicular to the paper feed direction in printing. The paper can be prevented from application of a load in nonprinting by releasing the urging to the side surface of the paper when the lid member is brought into a closed state.

In the aforementioned paper feed cassette according to the second aspect, the engaging portion of the first lift member preferably includes a pair of engaging portions protruding outward from both side surfaces of the first lift member. According to this structure, the pair of engaging portions can support the vicinity of both sides of the second lift member, whereby the second lift member can be lifted up in a stable state.

In the aforementioned paper feed cassette according to the second aspect, a recess portion in which the engaging portion of the first lift member is arranged when the first lift member is not lifted up is preferably formed on a bottom surface of the cassette body. According to this structure, the engaging portion is arranged in the recess portion when the first and second lift members are not lifted up, whereby a paper placement surface of the first lift member and a paper placement surface of the second lift member can be substantially aligned with each other.

In the aforementioned paper feed cassette according to the second aspect, a support portion for supporting the paper is preferably formed on a bottom surface of the cassette body, and the height of the support portion of the cassette body is preferably substantially same as the height of a paper placement surface of the first lift member when not lifting up the first lift member and the height of a paper placement surface of the second lift member when not lifting up the second lift member. According to this structure, the paper can be stored in the cassette body in a flat state in nonprinting.

In the aforementioned paper feed cassette according to the second aspect, the first lift member may be rotatably mounted on a bottom surface of the cassette body in a first direction, and the second lift member may be rotatably mounted on the bottom surface of the cassette body in a second direction different from the first direction.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will be hereinafter described with reference to the drawings.

Structures of a paper feed cassette 10 according to the embodiment of the present invention and a thermal transfer printer 20 mounted with the paper feed cassette 10 will be now described with reference to FIGS. 1 to 13. This embodiment of the present invention is applied to the thermal transfer printer employed as an exemplary image generating apparatus mounted with the paper feed cassette of the present invention.

Figure 1:
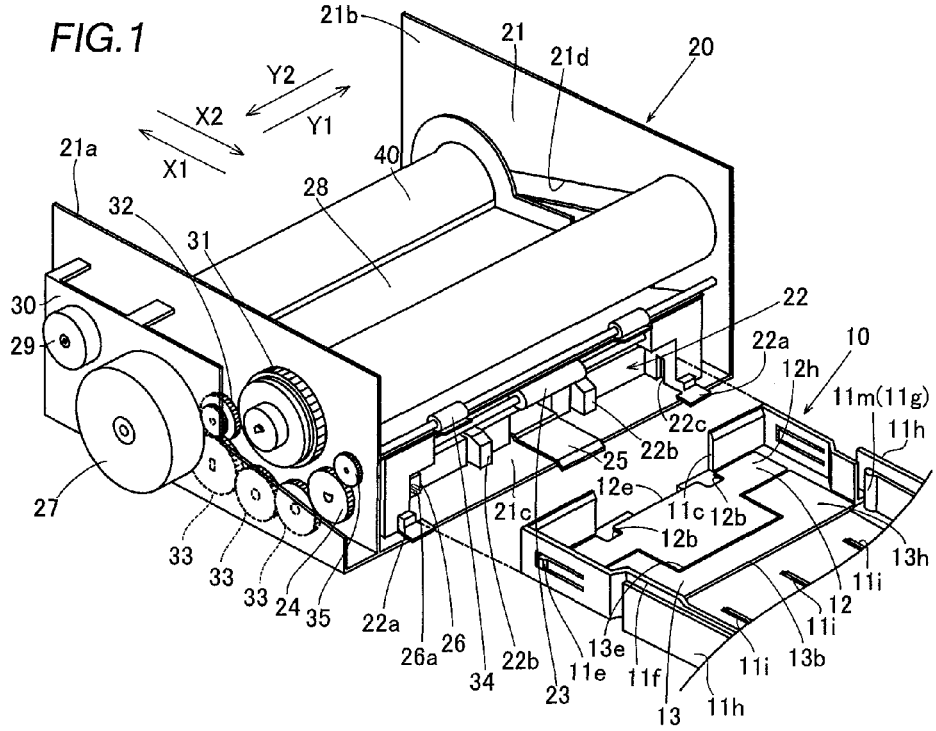
FIG. 1 is a perspective view showing an overall structure of a paper feed cassette according to an embodiment of the present invention and a thermal transfer printer mounted with the paper feed cassette.
Figure 2:
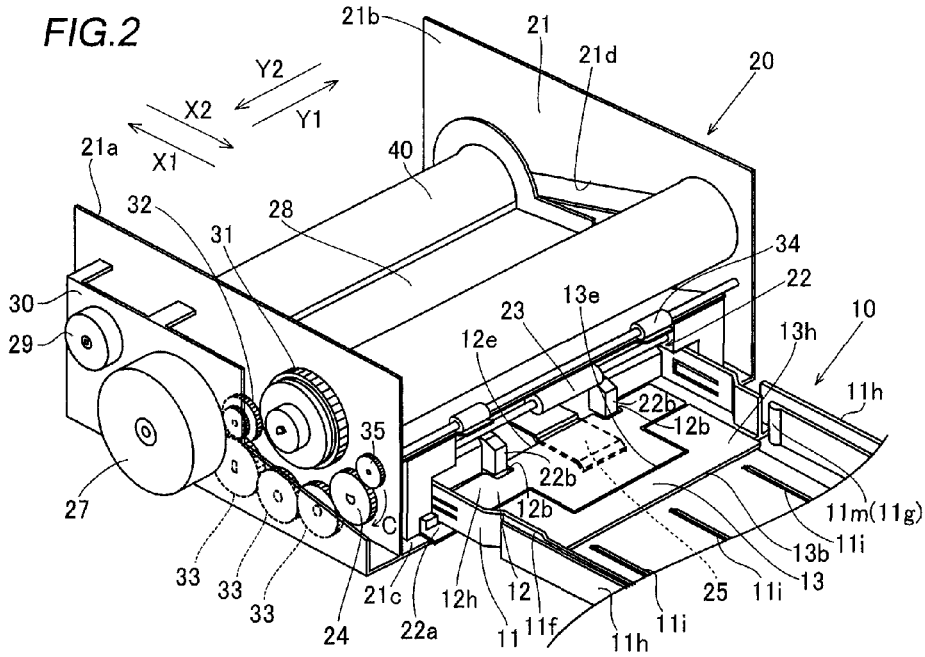
FIG. 2 is a perspective view showing an overall structure of the paper feed cassette according to the embodiment shown in FIG. 1 and a thermal transfer printer mounted with the paper feed cassette.

The paper feed cassette 10 according to the embodiment of the present invention is so formed as to be detachably mounted on the thermal transfer printer 20 as shown in FIGS. 1 and 2. The paper feed cassette 10 comprises a cassette body 11, lift members 12 and 13, and lid member 14 as shown in FIG. 3.

Figure 3:
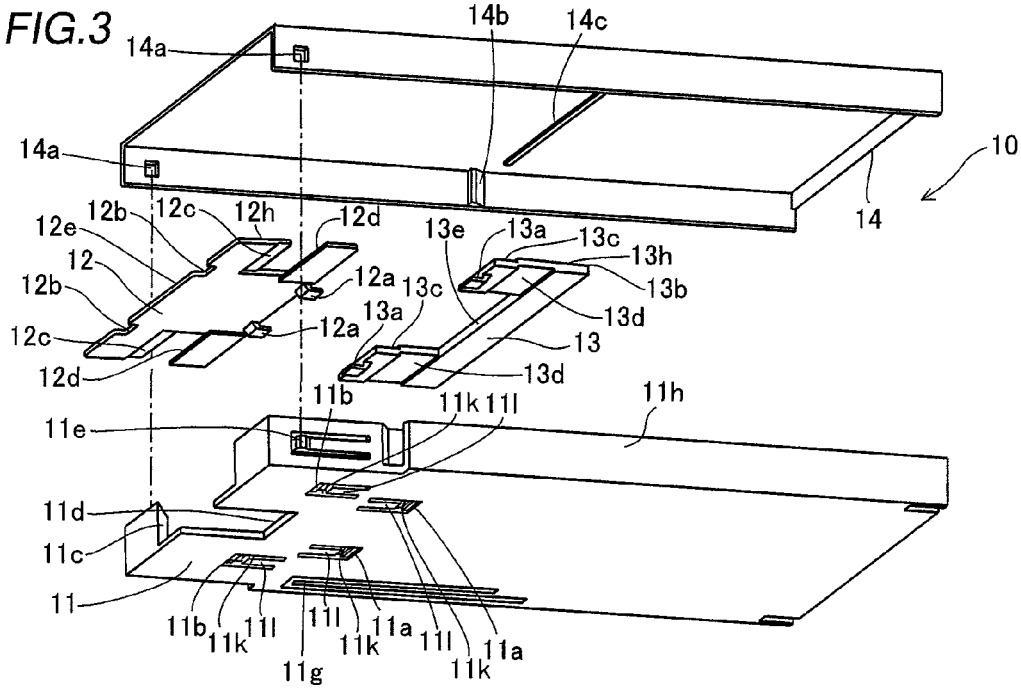
FIG. 3 is an exploded perspective view showing an overall structure of the paper feed cassette according to the embodiment shown in FIG. 1.
Figure 4:
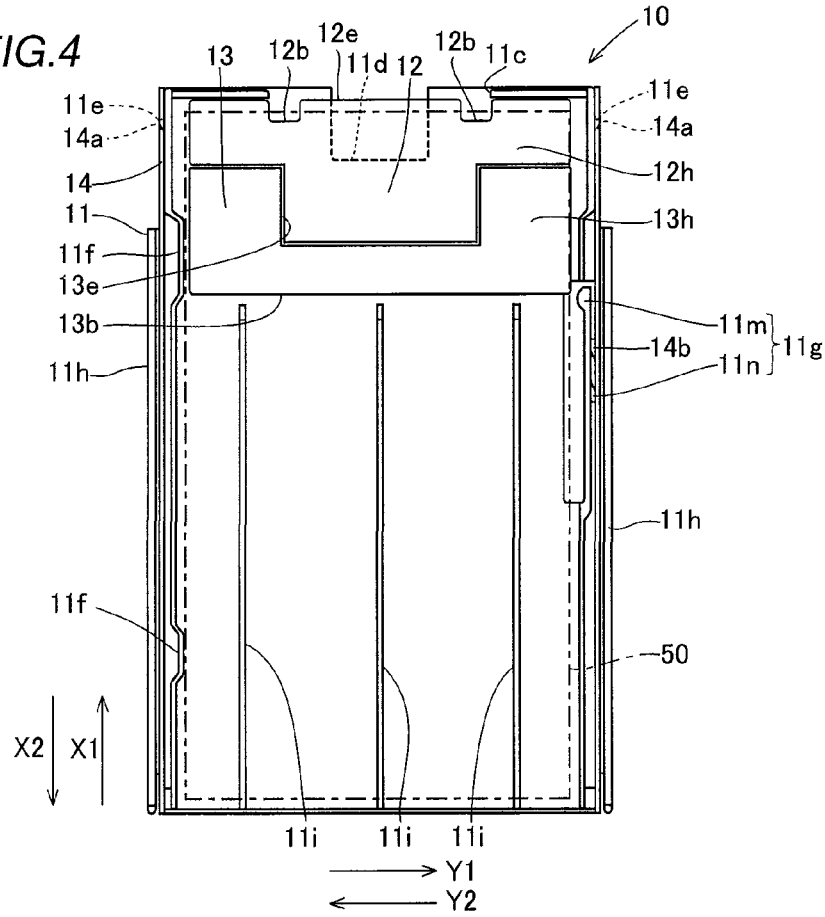
FIG. 4 is a schematic diagram showing the closed paper feed cassette according to the embodiment shown in FIG. 1.
Figure 5:
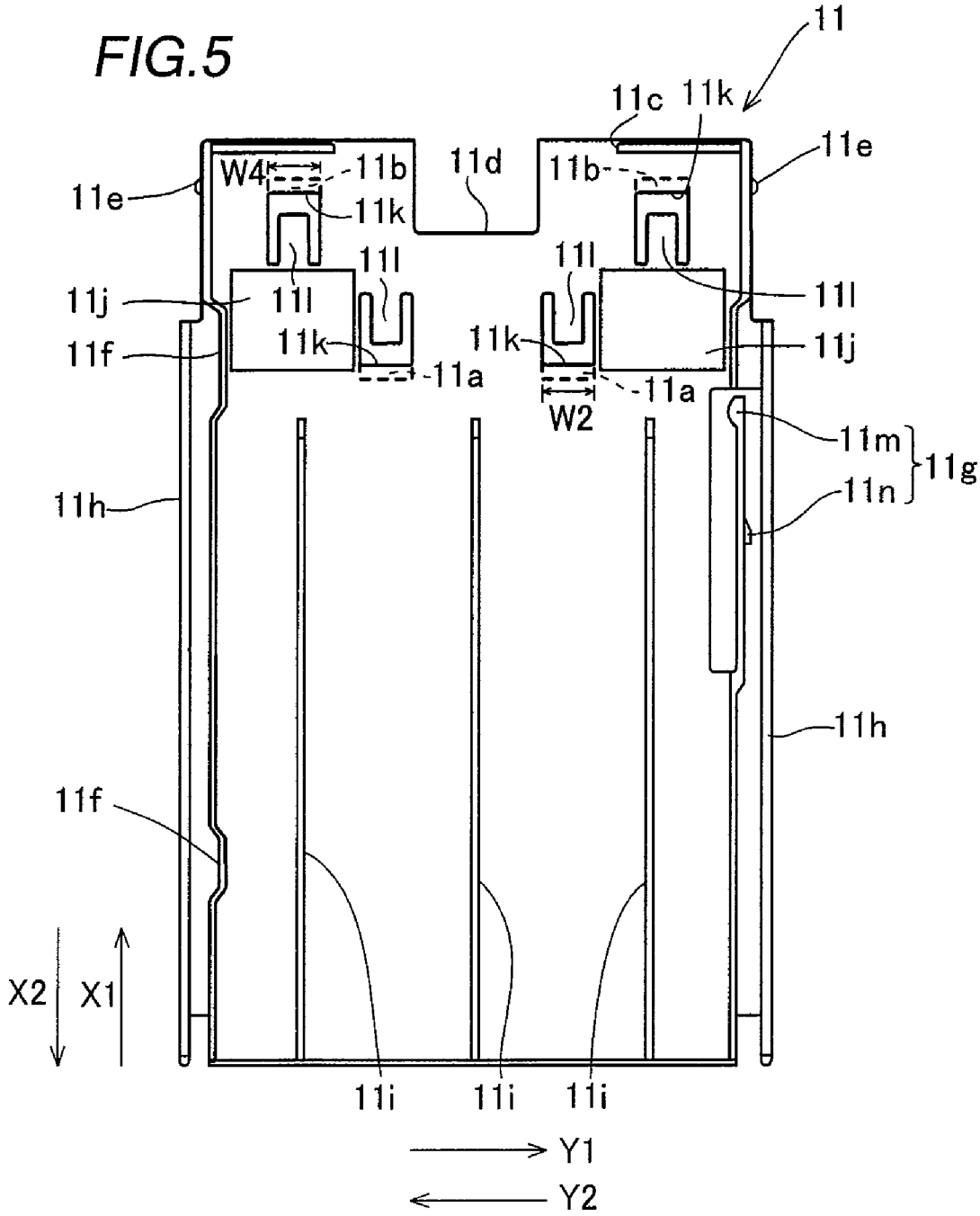
FIG. 5 is a plan view showing a cassette body of the paper feed cassette according to the embodiment shown in FIG. 1.

The cassette body 11 of the paper feed cassette 10 is made of resin, and provided for storing papers 50 fed to the thermal transfer printer 20 as shown in FIGS. 3 to 5. The cassette body 11 includes a pair of engaging portions 11*a* rotatably engaged with the lift member 12, a pair of engaging portions 11*b* rotatably engaged with the lift member 13, a pair of notches 11*c* for relieving an after-mentioned pair of paper separating walls 22*b*, a notch lid for relieving after-mentioned push-up member 25, a pair of elastically deformable mounting portions 11*e*, two projecting portions 11*f* for aligning a position along arrow Y1 (along arrow Y2) of the papers 50, a paper urging portion 11*g* for urging the papers 50 against the projecting portions 11*f*, guide portions 11*h* slidably guiding the lid member 14 with respect to the cassette body 11, and three support portions 11*i* for supporting the papers 50, extending along arrow X1 (along arrow X2), and a pair of recess portions 11*j* receiving after-mentioned engaging portions 12*d* of the lift member 12. The paper urging portion 11*g* is an example of the "urging portion" in the present invention.

The pair of engaging portions 11*a* and 11*b* of the cassette body 11 are formed in the bottom portion of the cassette body 11 as shown in FIGS. 3 and 5. After-mentioned receiving holes 11*k* receiving engaging portions 12*a* of the lift member 12 and engaging portions 13*a* of the lift member 13, and plate spring portions (resin spring portions) 111 are formed in the vicinity of the engaging portions 11*a* and 11*b* respectively.

The pair of mounting portions 11*e* of the cassette body 11 are integrally provided with the cassette body 11 so as to have outer protrusions protruding from outer side surfaces of the cassette body 11 respectively. Each mounting portions 11*e* has a function of fixing the paper feed cassette 10 to the thermal transfer printer 20 by engaging with an after-mentioned mounting portions 22*c* of the thermal transfer printer 20 when the paper feed cassette 10 is mounted on the thermal transfer printer 20.

The paper urging portion 11*g* of the cassette body 11 has a contact portion 11*m* protruding from an inner side surface along arrow Y2 and a contact portion 11*n* protruding from an outer side surface along arrow Y1. The contact portion 11*m* is formed in the vicinity of an after-mentioned paper support portion 13*b* of the lift member 13 as shown in FIG. 4. The contact portion 11*n* is provided for coming into contact with an after-mentioned press portion 14*b* of the lid member 14 to move the contact portion 11*m* along arrow Y2 when the lid member 14 is in an open state (see FIG. 13) and for separating from the press portion 14*b* of the lid member 14 to release the movement of the contact portion 11*m* along arrow Y2 when the lid member 14 is in a closed state (see FIG. 4). Thus, a first side surface of the papers 50 stored in the cassette body 11 is urged along arrow Y2 by the paper urging portion 11*g* so that a second side surface of the papers 50 comes into contact with the two projecting portions 11*f* to align the position of the papers 50 along arrow Y1 (along arrow Y2) when the lid member 14 is in the open state (see FIG. 13), while the first side surface of the papers 50 stored in the cassette body 11 is not urged along arrow Y2 by the paper urging portion 11*g* when the lid member 14 is in the closed state (see FIG. 4).

Each of the three support portions 11*i* of the cassette body 11 has a function as a guide for carrying the papers 50 in paper feeding, and is so formed as to extend from an rear end of the cassette body 11 to the vicinity of the paper support portion 13*b* of the lift member 13.

Figure 6:
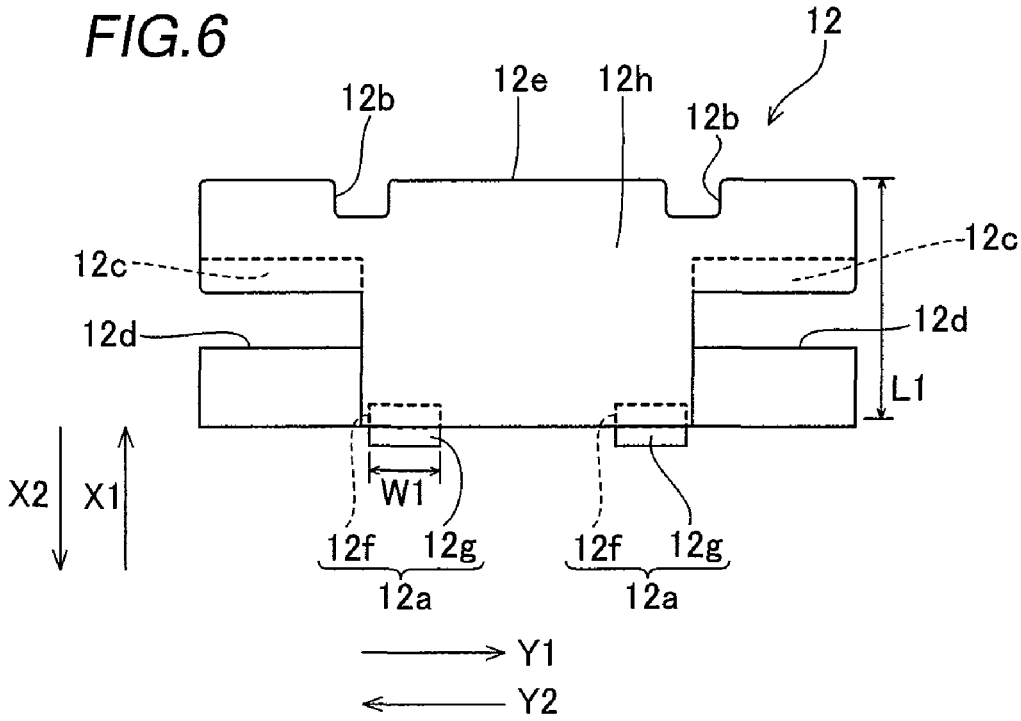
FIG. 6 is a plan view showing a lift member of the paper feed cassette according to the embodiment shown in FIG. 1.
Figure 7:
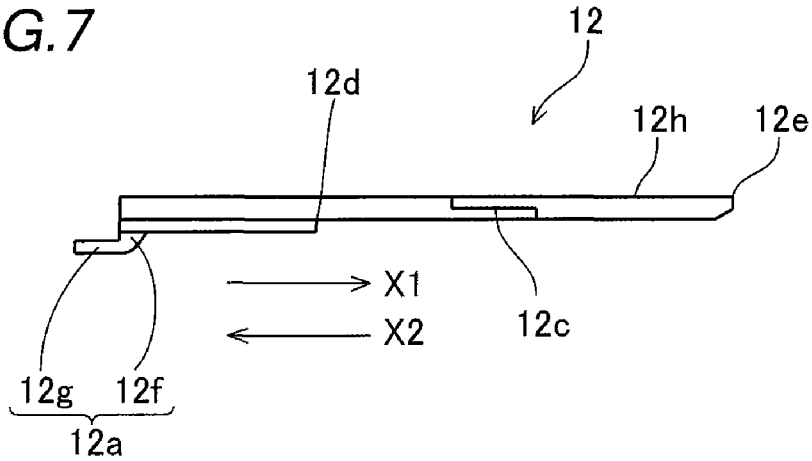
FIG. 7 is a side elevational view showing the lift member of the paper feed cassette according to the embodiment shown in FIG. 1.

According to this embodiment, the lift member 12 of the paper feed cassette 10 is made of resin and provided for bringing the papers 50 (see FIG. 11) into contact with an after-mentioned paper feed roller 23 of the thermal transfer printer 20 in paper feeding (printing). The lift member 12 includes a pair of the engaging portions 12*a* engaging with the pair of engaging portions 11*a* of the cassette body 11 respectively, a pair of notches 12*b* for relieving a pair of the paper separating walls 22*b* respectively when the paper feed cassette 10 is mounted on the thermal transfer printer 20, a pair of concave relief portions 12*c*, a pair of engaging portions 12*d* engaging with a lower surface of the lift member 13, and a paper support portion 12*e* for supporting the papers 50 (see FIG. 4), as shown in FIGS. 6 and 7. The lift member 12 is an example of the "first lift member" in the present invention.

The engaging portions 12*a* of the lift member 12 have shaft portions 12*f* as a rotation axis for rotation of the lift member 12 and stop portions 12*g* so formed as to protrude from the shaft portions 12*f* along arrow X2 respectively. The stop portions 12*g* are so formed as to engage with the lower surface of the engaging portions 11*a* of the cassette body 11 by elastically deforming the plate spring portions 111 (see FIG. 3) inserted into the receiving holes 11*k* (see FIG. 3) respectively. Thus, the lift member 12 is mounted on the cassette body 11 rotatably about the shaft portions 12*f* in a direction A (see FIG. 11). The lift member 12 has a length L1 (see FIG. 6) from the shaft portions 12*f* to the paper support portion 12*e*.

The width W1 of each shaft portion 12*f* of the lift member 12 along arrow Y1 (along arrow Y2) is substantially same as the width W2 (see FIG. 5) of each engaging portion 11*a* of the cassette body 11 along arrow Y1 (along arrow Y2). Thus, the lift member 12 is inhibited from deviating along arrow Y1 (along arrow Y2) with respect to the cassette body 11.

According to this embodiment, a pair of the engaging portions 12*d* of the lift member 12 are so formed as to protrude outwardly.

According to this embodiment, the lift member 13 of the paper feed cassette 10 is made of resin and provided for producing bending G (see FIG. 11) caused by droop of the papers 50 along arrow X2 due to the own weight of the papers 50 in paper feeding (printing) as shown in FIGS. 8 to 12. The lift member 13 includes a pair of the engaging portions 13*a* engaging with a pair of the engaging portions 11*b* of the cassette body 11 respectively, the paper support portion 13*b* for supporting the papers 50, a pair of concave relief portions 13*c*, a pair of concave relief portions 13*d*, and a notch 13*e* receiving the lift member 12. The lift member 13 is an example of the "second lift member" in the present invention.

Figure 8:
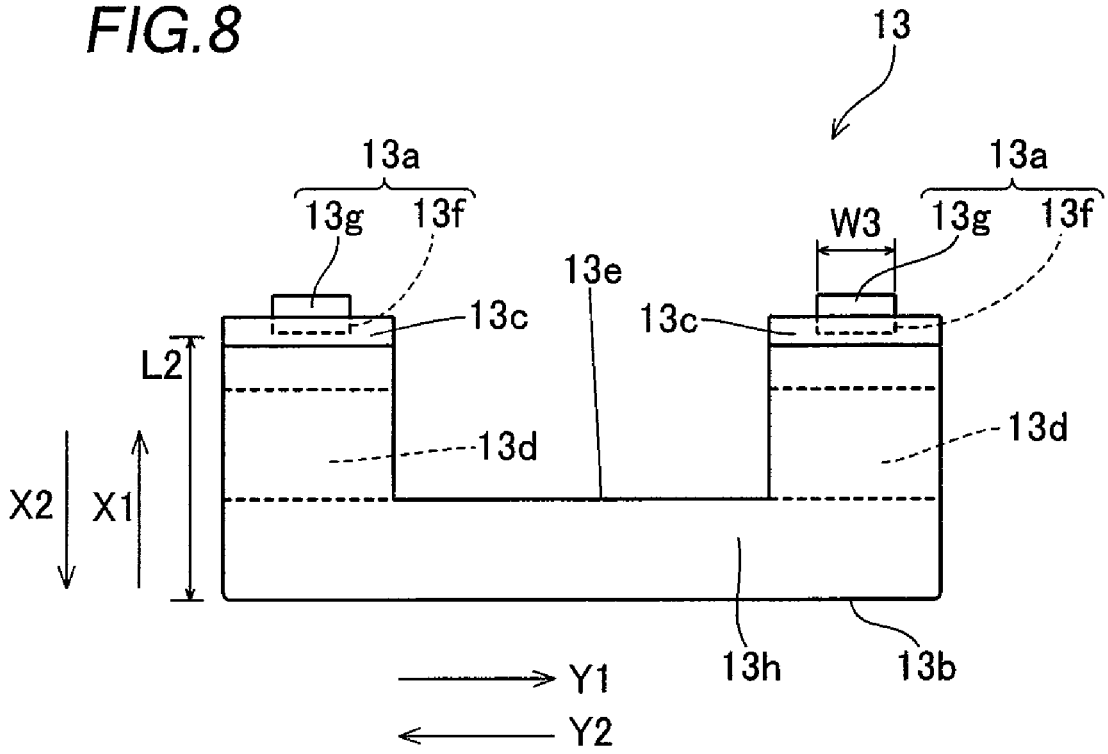
FIG. 8 is a plan view showing a lift member of the paper feed cassette according to the embodiment shown in FIG. 1.
Figure 9:
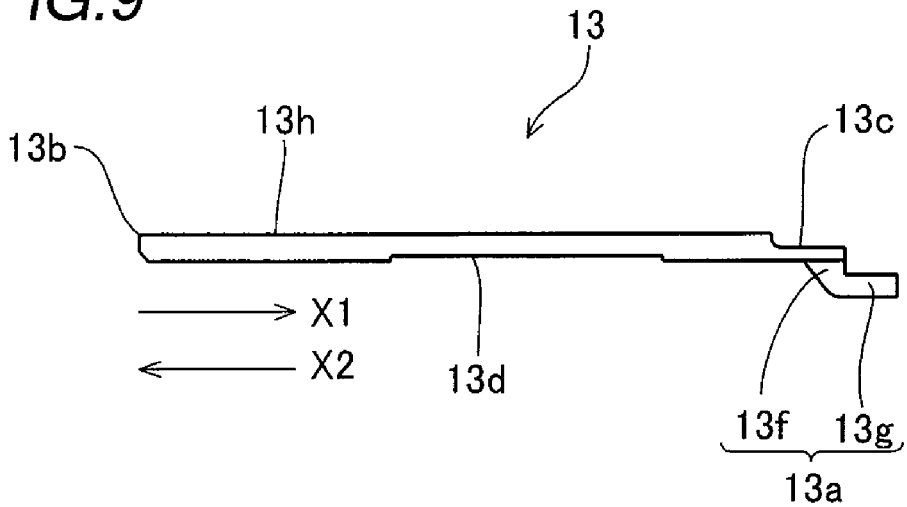
FIG. 9 is a side elevational view showing the lift member of the paper feed cassette according to the embodiment shown in FIG. 1.

The engaging portions 13*a* of the lift member 13 have shaft portions 13*f* as a rotation axis for rotation of the lift member 13 and stop portions 13*g* so formed as to protrude from the shaft portions 13*f* along arrow X1. The stop portions 13*g* are so formed as to engage with the lower surface of the engaging portion 11*b* of the cassette body 11 by elastically deforming the plate spring portions 111 (see FIG. 3) inserted into the receiving holes 11*k* (see FIG. 3) respectively. Thus, the lift member 13 is mounted on the cassette body 11 rotatably about the shaft portions 13*f* in a direction B (see FIG. 11). The lift member 13 has a length L2 from the shaft portion 13*f* to the paper support portion 13*b* as shown in FIG. 8. The length L2 of the lift member 13 is substantially same as the length L1 (see FIG. 6) of the lift member 12.

The width W3 of each shaft portion 13*f* of the lift member 13 along arrow Y1 (along arrow Y2) is substantially same as the width W4 (see FIG. 5) of each engaging portion 11*b* of the cassette body 11 along arrow Y1 (along arrow Y2). Thus, the lift member 13 is inhibited from deviating along arrow Y1 (along arrow Y2) with respect to the cassette body 11.

Figure 10:
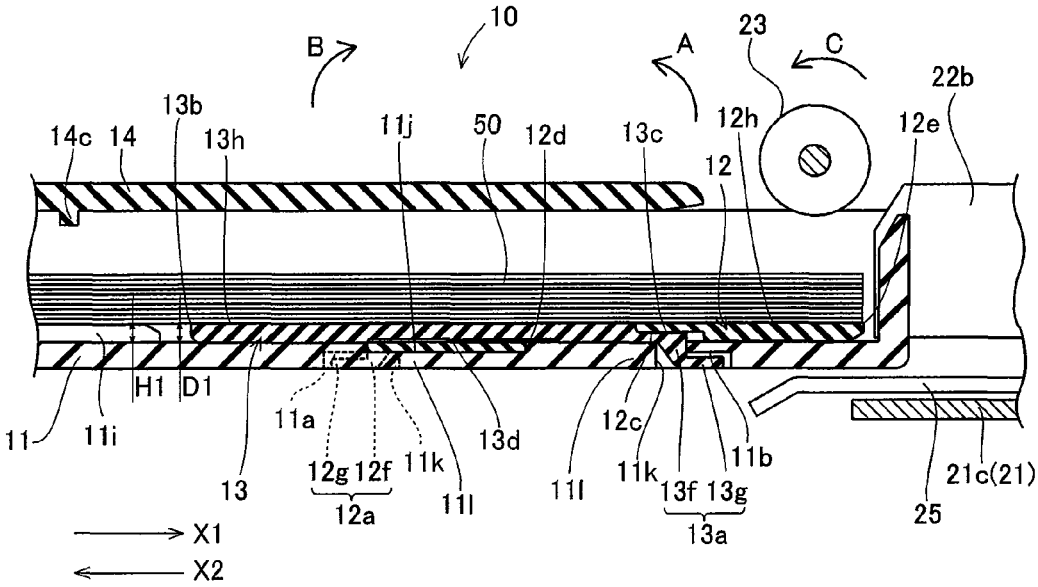
FIGS. 10 and 11 are sectional views showing the vicinity of the lift members with papers placed in the paper feed cassette according to the embodiment shown in FIG. 1.

According to this embodiment, the paper support portion 13*b* of the lift member 13 is so provided as to extend over a length substantially same as the width of the papers 50 along arrow Y1 (along arrow Y2) perpendicular to the paper feed direction (along arrow Xl) of the papers 50. The concave relief portions 13*c* on the upper surface of the lift member 13 are arranged below the concave relief portions 12*c* on the lower surface of the lift member 12 as shown in FIG. 10. The concave relief portions 13*d* on the lower surface of the lift member 13 are arranged above the engaging portions 12*d* of the lift member 12 arranged in recess portions 11*j* on the upper surface of the cassette body 11. Thus, a paper placement surface 12*h* of the lift member 12 and a paper placement surface 13*h* of the lift member 13 are so formed as to be substantially aligned with each other in a state where the lift members 12 and 13 are not lifted up. The distance D1 from a bottom surface of the cassette body 11 to the paper placement surfaces 12*h* and 13*h* is substantially same as the height H1 of the three support portions 11*i* of the cassette body 11. Thus, the papers 50 are stored in the cassette body 11 in a substantially horizontal state (flat state) with respect to the bottom surface of the cassette body 11 in nonprinting.

Figure 11:
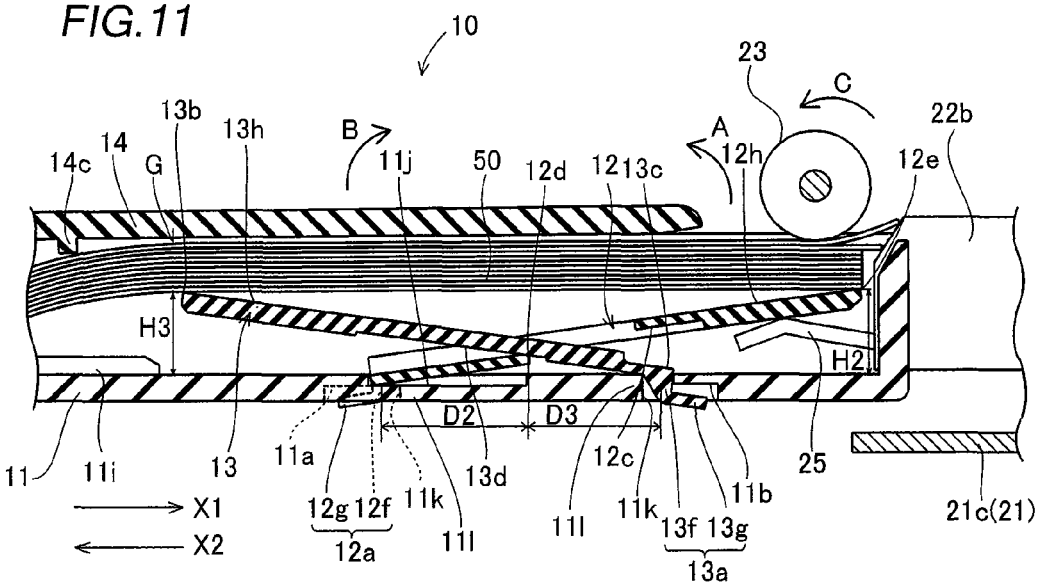
Figure 12:
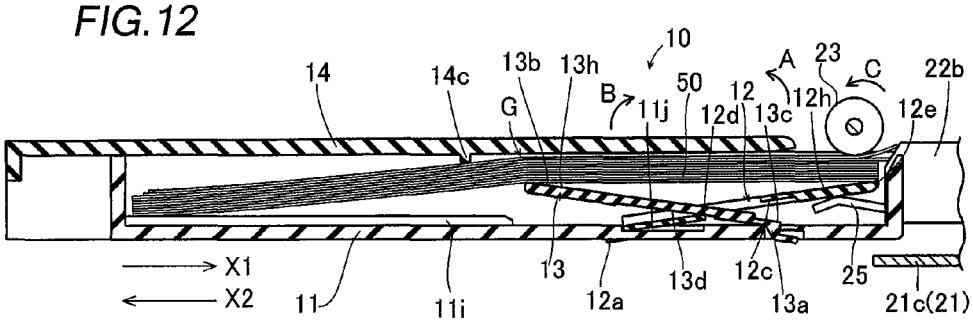
FIG. 12 is a sectional view showing the paper feed cassette according to the embodiment shown in FIG. 1, with the papers placed therein.
Figure 13:
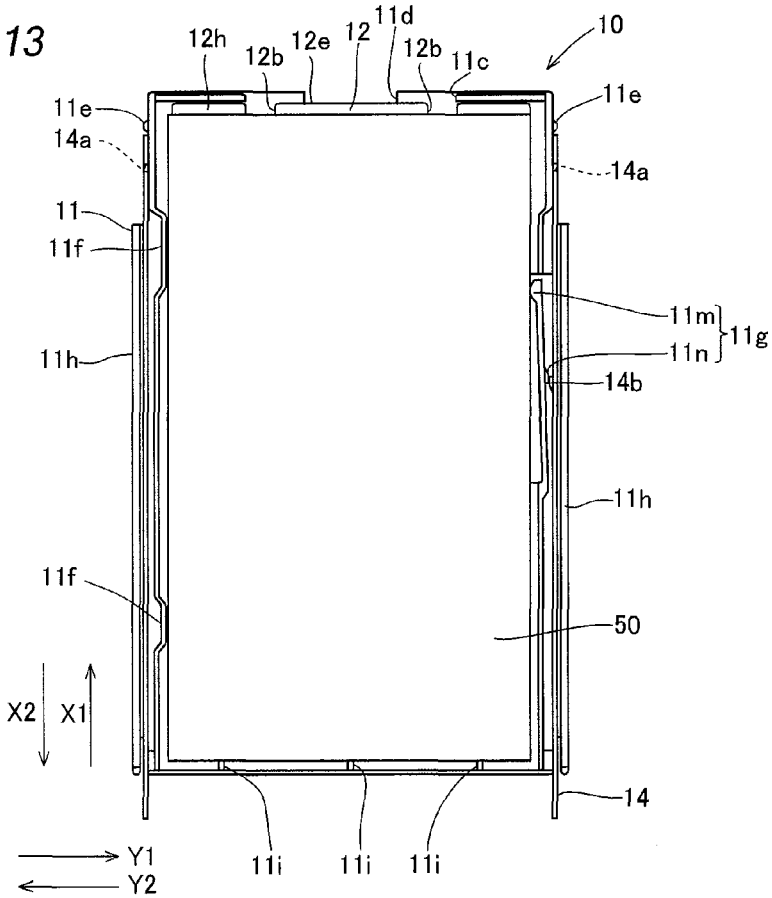
FIG. 13 is a schematic diagram showing the open paper feed cassette according to the embodiment shown in FIG. 1.

According to this embodiment, in the case of lifting up the lift member 12, the engaging portions 12*d* of the lift member 12 arranged below the relief portions 13*d* of the lift member 13 support the relief portions 13*d* respectively so that the lift member 13 is lifted up, as shown in FIGS. 11 and 12. The distance D2 from the shaft portions 12*f* of the lift member 12 to the engaging portions 12*d* of the lift member 12 is substantially same as the distance D3 from the shaft portions 13*f* of the lift member 13 to the engaging portions 12*d* of the lift member 12, while the length L1 (see FIG. 6) of the lift member 12 and the length L2 (see FIG. 8) of the lift member 13 are substantially same as each other. Thus, the height H2 of the paper support portion 12*e* for lifting up the lift member 12 and the height of the H3 of the paper support portion 13*b* are substantially same as each other.

The lid member 14 of the paper feed cassette 10 is slidably mounted with respect to the cassette body 11 for inhibiting dust or the like from penetrating inside the cassette body 11. The lid member 14 is made of resin and includes engaging portions 14*a* engaging with the mounting portions 11*e* of the cassette body 11 when in the closed state, the press portion 14*b* pressing the contact portion 11*n* of the cassette body 11 when in the open state, and a contact portion 14*c* protruding downwardly, as shown in FIG. 3. When the paper feed cassette 10 is not mounted on the thermal transfer printer 20, the engaging portions 14*a* of the lid member 14 engages with the mounting portions 11*e* of the cassette body 11 respectively. On the other hand, although not shown, when the paper feed cassette 10 is mounted on the thermal transfer printer 20, engagement between the mounting portions 11*e* of the cassette body 11 and the engaging portions 14*a* of the lid member 14 are released from each other by a user. Therefore, the paper feed cassette 10 can be mounted on the thermal transfer printer 20 in a state of sliding the lid member 14 along the guide portions 11*h* of the cassette body 11 along arrow X2 with respect to the cassette body 11. Thus, the paper feed cassette 10 is formed such that the lid member 14 has no influence on the paper feed operation. The contact portion 14*c* of the lid member 14 is integrally formed so as to extend along arrow Y1 (along arrow Y2).

The thermal transfer printer 20 has a chassis 21 made of metal, a paper feed cassette mounting portion 22, a paper feed roller 23 made of rubber for carrying the papers 50 (see FIG. 11) inside the thermal transfer printer 20, a paper feed roller gear 24, the push-up member 25 pushing up the lift member 12 with the papers 50 (see FIG. 11) stacked thereon and pressing the papers 50 (see FIG. 11) against the paper feed roller 23, a sensor portion 26 sensing that the paper feed cassette 10 is mounted on the thermal transfer printer 20, a motor 27 for driving the paper feed roller 23 and the like, a print head 28 for printing an image on the papers 50 (see FIG. 11), a motor 29 for driving a press member (not shown) pressing the print head 28 and the push-up member 25, a motor bracket 30 for mounting the motors 27 and 29, a take-up reel 31 for taking up an ink sheet (not shown) of an ink sheet cartridge 40, a swingable swing gear 32 for transmitting driving force of the motor 27 to the take-up reel 31, a plurality of intermediate gears 33 for transmitting driving force of the motor 27 to the paper feed roller gear 24, discharge rollers 34 made of rubber and a discharge roller gear 35, as shown in FIGS. 1 and 2. The thermal transfer printer 20 is so formed as to be detachably mounted with the ink sheet cartridge 40 as shown in FIGS. 1 and 2.

The chassis 21 of the thermal transfer printer 20 includes a first side surface 21*a* on which the motor bracket 30 is mounted, a second side surface 21*b* and a bottom surface 21*c* connecting the first and second side surfaces 21*a* and 21*b* with each other, as shown in FIGS. 1 and 2. The second side surface 21*b* of the chassis 21 is provided with an ink sheet cartridge receiving hole 21*d* for mounting the ink sheet cartridge 40.

The paper feed cassette mounting portion 22 of the thermal transfer printer 20 includes a pair of guide portions 22*a* for mounting the paper feed cassette 10 on the thermal transfer printer 20, a pair of paper separating walls 22*b* for preventing double feeding of the papers 50 (see FIG. 11), and a pair of the mounting portions 22*c* engaging with the pair of mounting portions 11*e* of the cassette body 11 when the paper feed cassette 10 is mounted on the thermal transfer printer 20.

When the paper feed cassette 10 is mounted on the thermal transfer printer 20, the pair of paper separating walls 22*b* are arranged in the notches 11*c* of the cassette body 11 and a pair of the notches 12*b* of the lift member 12 as shown in FIG. 2. At this time, the paper feed roller 23 is arranged above the lift member 12 and the push-up member 25 is arranged below the lift member 12 as shown in FIG. 10.

The paper feed roller 23 of the thermal transfer printer 20 has a function of carrying the papers 50 (see FIG. 11) pushed up by the push-up member 25 inside the thermal transfer printer 20 by rotation. The paper feed roller gear 24 is mounted on a first end of the paper feed roller 23 as shown in FIGS. 1 and 2. The paper feed roller 23 is so formed as to rotate following the rotation of the paper feed roller gear 24.

The sensor portion 26 of the thermal transfer printer 20 is arranged in the vicinity of the first end of the paper feed cassette mounting portion 22. The sensor portion 26 has a protrusion 26*a*. When the paper feed cassette 10 is mounted on the paper feed cassette mounting portion 22 of the thermal transfer printer 20, the protrusion 26*a* is pushed in with the paper feed cassette 10 and therefore the sensor portion 26 senses that the paper feed cassette 10 has been mounted.

With reference to FIGS. 1 and 2 and FIGS. 10 to 12, a description will be now made of a paper feed operation of the paper feed cassette 10 according to the embodiment of the present invention and the thermal transfer printer 20.

As shown in FIG. 2, the paper feed cassette 10 is mounted on the thermal transfer printer 20 from a state shown in FIG.

1. In the paper feed cassette 10, the papers 50 are placed on the paper placement surface 12*h* of the lift member 12, the paper placement surface 13*h* of the lift member 13 and the three support portions 11*i* of the cassette body 11 as shown in FIG. 10. In the case where the paper feed cassette 10 is mounted on the thermal transfer printer 20, the push-up member 25 is arranged below the lift member 12 (at a position corresponding to the notch lid of the cassette body 11) and the paper feed roller 23 is arranged above the lift member 12 placed with the papers 50 thereon, as shown in FIGS. 2 and 10.

In this state, the motor 29 (see FIG. 2) is driven. The driving force of the motor 29 (see FIG. 2) is transmitted to the push-up member 25 through a driving force transfer mechanism (not shown). Thus, the push-up member 25 is rotated in a direction B (upward) as shown in FIGS. 11 and 12. At this time, the push-up member 25 comes into contact with the lower surface of the lift member 12, thereby rotating the lift member 12 about the shaft portions 12*f* of the engaging portions 12*a* in the direction A. The direction A is an example of the "first direction" in the present invention. At this time, engaging portions 12*d* of the lift member 12 engages with the relief portions 13*d* of the lift member 13, thereby rotating the lift member 13 about the shaft portions 13*f* of the engaging portions 13*a* in the direction B. The direction B is an example of the "second direction" in the present invention. Thus, the papers 50 stored in the cassette body 11 are pushed upward until the same comes into contact with the paper feed roller 23, and produce the bending G in the papers 50 due to droop. At this time, the papers 50 are supported by the paper support portion 12*e* of the lift member 12 and the paper support portion 13*b* of the lift member 13 and come into contact with the contact portion 14*c* of the lid member 14.

Thereafter the motor 27 (see FIG. 2) is driven. The driving force of the motor 27 is transmitted to the paper feed roller gear 24 through the plurality of intermediate gears 33 as shown in FIG. 2. Thus, the paper feed roller gear 24 is rotated in a direction C, thereby rotating the paper feed roller 23 in the direction C. The papers 50 are carried inside the thermal transfer printer 20 with frictional force between the paper feed roller 23 and the papers 50.

According to this embodiment, as hereinabove described, the lift member 13 for lifting up the paper 50 so as to produce the bending G (see FIG. 11) caused by droop of the papers 50 along arrow X2 due to the own weight of the papers 50 is provided, whereby the papers 50 linearly extend in a direction in which the bending G (see FIG. 11) due to the droop extends (in a direction substantially perpendicular to the paper feed direction (along arrow Y1 and along arrow Y2)) and therefore the papers 50 can be inhibited from being warped along arrow Y1 (along arrow Y2). Thus, the papers 50 can be inhibited from deviating along arrow Y1 (along arrow Y2) due to the warpage of the papers 50, thereby allowing improvement in printing quality. Additionally, simply adding the one lift member 13 can inhibit the papers 50 from being warped along arrow Y1 (along arrow Y2), whereby increase in the number of components can be minimized. The lift member 12 and the lift member 13 are so formed as to lift up the papers 50 in paper feeding (printing), whereby the papers 50 are curved due to droop only in paper feeding (printing) while the papers 50 are not curved in nonprinting. Thus, the papers 50 can be inhibited from being plastically deformed into a curved shape.

According to this embodiment, the lift member 13 includes the paper support portion 13*b* so formed as to come into contact with the papers 50 when lifting up the papers 50 and extend along arrow Y1 (along arrow Y2), whereby droop due to the own weight of the papers 50 can be easily produced along the paper support portion 13*b* of the lift member 13.

According to this embodiment, the cassette body 11 includes the paper urging portion 11*g* urging the side surface of the papers 50 along arrow Y2 in the vicinity of a portion at which the paper support portion 13*b* of the lift member 13 and the papers 50 come into contact with each other, whereby the first side surface of the papers 50 can be urged along arrow Y2 by the paper urging portion 11*g* in the vicinity of the portion at which the papers 50 are inhibited from being warped along arrow Y1 (along arrow Y2) so that positioning of the papers 50 along arrow Y1 (along arrow Y2) can be accurately performed. Thus, the papers 50 can be inhibited from deviating along arrow Y1 (along arrow Y2).

According to this embodiment, the lift member 12 includes the engaging portions 12*d* engaging with the lower surface of the lift member 13, and the lift member 13 is lifted up by the engaging portions 12*d* of the lift member 12 when the lift member 12 is lifted up, whereby the lift member 13 can be easily lifted up by lifting up the lift member 12.

According to this embodiment, the height H3 of the lift member 13 is so formed as to be substantially same as the height H2 of the lift member 12, whereby the papers 50 are fed in the horizontal state with respect to the paper separating walls 22*b* of the thermal transfer printer 20. Therefore, the paper separating walls 22*b* can easily perform paper separation. Thus, double feeding of the papers 50 can be further suppressed.

According to this embodiment, the lid member 14 integrally formed with the contact portion 14*c* coming into contact with the papers 50 when the papers 50 are lifted up is provided, whereby the contact portion 14*c* of the lid member 14 can easily produce the bending G (see FIG. 11) due to droop while inhibiting the number of component from increase.

According to this embodiment, the paper urging portion 11*g* urges the first side surface of the papers 50 stored in the cassette body 11 along arrow Y2 when the lid member 14 is in the open state, while the paper urging portion 11*g* does not urge the first side surface of the papers 50 stored in the cassette body 11 along arrow Y2 when the lid member 14 is in the closed state. Thus, the papers 50 can be inhibited from deviating along arrow Y1 (along arrow Y2) in printing, while the papers 50 can be prevented from application of a load in nonprinting.

According to this embodiment, the pair of engaging portions 12*d* engaging with the lift member 13 are formed in the lift member 12, whereby the vicinity of both sides of the lift member 13 can be supported. Thus, the lift member 13 can be lifted up in a stable state.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment is applied to the thermal transfer printer employed as an exemplary image generating apparatus on which the paper feed cassette is mounted, the present invention is not restricted to this but is also applicable to another image generating apparatus other than the thermal transfer printer so far as the paper feed cassette is mounted on the same.

While the push-up member 25 lifts up the lift member 12 and the lift member 12 lifts up the lift member 13 in the aforementioned embodiment, the present invention is not restricted to this but the press member may be alternatively lifts up the two lift members.

While the height H2 of the lift member 12 and the height H3 of the lift member 13 are the same as each other in the aforementioned embodiment, the present invention is not restricted to this but the height of the lift member 13 may be larger than that of the lift member 12 for easily producing the bending due to droop in the papers.

Figure 14:
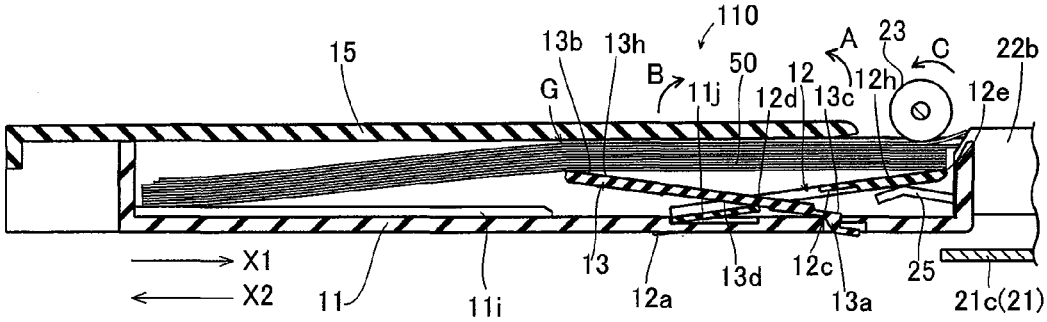
FIG. 14 is a sectional view showing a paper feed cassette according to a modification of the embodiment of the present invention, with the papers placed therein.

While the contact portion 14*c* coming into contact with the papers 50 is integrally provided in the lid member 14 in the aforementioned embodiment, the present invention is not restricted to this but a lid member with no contact portion may be alternatively employed like a paper feed cassette 110 according to a modification of the embodiment shown in FIG. 14, which can produce the bending G due to droop in the papers 50 also in the case where a lid member 15 has no contact portion.

While the paper support portion 13*b* of the lift member 13 are formed to have a length substantially same as the width of the papers 50 in the aforementioned embodiment, the present invention is not restricted to this but the paper support portion 13*b* of the lift member 13 may be alternatively formed to have a length larger than the width of the papers 50.

What is claimed is:

1. A paper feed cassette comprising:

a cassette body mounted on an image generating apparatus including a paper feed roller and storing a paper;

a first lift member for lifting up said paper so as to bring said paper into contact with said paper feed roller of said image generating apparatus in printing; and a second lift member for lifting up said paper so as to produce bending caused by droop of a rear in a paper feed direction of said paper due to said paper's own weight in printing, wherein:

an end of said first lift member supports said paper by directly contacting said paper at a first contact position, in a state that said first lift member inclines with respect to a horizontal plane that is parallel to said paper feed direction, and an end of said second lift member supports said paper by directly contacting said paper at a second contact position that is physically separate from said first contact position so as to produce said bending caused by said droop of said rear of said paper, in a state that said second lift member inclines with respect to said horizontal plane.

2. The paper feed cassette according to claim 1, wherein said second lift member includes a paper support portion so formed as to come into contact with said paper when said paper is lifted up and extend in a direction substantially perpendicular to said paper feed direction.

3. The paper feed cassette according to claim 2, wherein said paper support portion of said second lift member has a length substantially not less than a width of said paper in said direction substantially perpendicular to said paper feed direction.

4. The paper feed cassette according to claim 2, wherein said cassette body includes an urging portion urging a side surface of said paper in said direction substantially perpendicular to said paper feed direction in a vicinity of a portion at which said paper support portion of said second lift member and said paper come into contact with each other.

5. The paper feed cassette according to claim 4, further comprising a lid member covering said paper stored in said cassette body, wherein said urging portion of said cassette body is so formed as to urge said side surface of said paper in said direction substantially perpendicular to said paper feed direction when said lid member is in an open state for mounting said cassette body on said image generating apparatus.

6. The paper feed cassette according to claim 1, wherein said first lift member includes an engaging portion engaging with a lower surface of said second lift member, and said second lift member is lifted up by said engaging portion of said first lift member when said first lift member is lifted up.

7. The paper feed cassette according to claim 6, wherein said engaging portion of said first lift member includes a pair of engaging portions protruding outward from both side surfaces of said first lift member.

8. The paper feed cassette according to claim 6, further comprising a recess portion formed on a bottom surface of said cassette body, wherein said engaging portion of said first lift member is arranged in said recess portion when said first lift member is not lifted up.

9. The paper feed cassette according to claim 1, wherein a position of said second lift member in a height direction when lifting up said second lift member is substantially same as a position of said first lift member in a height direction when lifting up said first lift member.

10. The paper feed cassette according to claim 1, wherein a support portion for supporting said paper is formed on a bottom surface of said cassette body, and a height of said support portion of said cassette body is substantially same as a height of a paper placement surface of said first lift member when not lifting up said first lift member and a height of a paper placement surface of said second lift member when not lifting up said second lift member.

11. The paper feed cassette according to claim 1, further comprising a lid member covering said paper stored in said cassette body, wherein said lid member is integrally provided with a contact portion coming into contact with said paper when said paper is lifted up.

12. The paper feed cassette according to claim 1, wherein said first lift member is rotatably mounted on a bottom surface of said cassette body in a first direction, and said second lift member is rotatably mounted on said bottom surface of said cassette body in a second direction different from said first direction.

13. A paper feed cassette comprising:

a cassette body mounted on an image generating apparatus including a paper feed roller and storing a paper;

a first lift member for lifting up said paper so as to bring said paper into contact with said paper feed roller of said image generating apparatus in printing; and a second lift member for lifting up said paper so as to produce bending caused by droop of a rear in a paper feed direction of said paper due to said paper's own weight in printing, wherein:

said first lift member includes an engaging portion engaging with a lower surface of said second lift member, said second lift member includes a paper support portion so formed as to come into contact with said paper when said paper is lifted up and extend in a direction substantially perpendicular to said paper feed direction, and is lifted up by said engaging portion of said first lift member when said first lift member is lifted up, a position of said second lift member in a height direction when lifting up said second lift member is substantially same as a position of said first lift member in the height direction when lifting up said first lift member, said cassette body includes an urging portion urging a side surface of said paper in said direction substantially perpendicular to said paper feed direction in a vicinity of a portion at which said paper support portion of said second lift member and said paper come into contact with each other, an end of said first lift member supports said paper by directly contacting said paper at a first contact position, in a state that said first lift member inclines with respect to a horizontal plane that is parallel to said paper feed direction, and said paper support portion of said second lift member is at an end of said second lift member and supports said paper by directly contacting said paper at a second contact position that is physically separate from said first contact position so as to produce said bending caused by said droop of said rear of said paper, in a state that said second lift member inclines with respect to said horizontal plane.

14. The paper feed cassette according to claim 13, wherein said paper support portion of said second lift member has a length substantially not less than a width of said paper in said direction substantially perpendicular to said paper feed direction.

15. The paper feed cassette according to claim 13, further comprising a lid member covering said paper stored in said cassette body, wherein said urging portion of said cassette body is so formed as to urge said side surface of said paper in said direction substantially perpendicular to said paper feed direction when said lid member is in an open state for mounting said cassette body on said image generating apparatus.

16. The paper feed cassette according to claim 13, wherein said engaging portion of said first lift member includes a pair of engaging portions protruding outward from both side surfaces of said first lift member.

17. The paper feed cassette according to claim 13, further comprising a recess portion formed on a bottom surface of said cassette body, wherein said engaging portion of said first lift member is arranged in said recess portion when said first lift member is not lifted up.

18. The paper feed cassette according to claim 13, wherein a support portion for supporting said paper is formed on a bottom surface of said cassette body, and a height of said support portion of said cassette body is substantially same as a height of a paper placement surface of said first lift member when not lifting up said first lift member and a height of a paper placement surface of said second lift member when not lifting up said second lift member.

19. The paper feed cassette according to claim 13, wherein said first lift member is rotatably mounted on a bottom surface of said cassette body in a first direction, and said second lift member is rotatably mounted on said bottom surface of said cassette body in a second direction different from said first direction.

* * * * *